United States Patent [19]

Coats et al.

[11] 3,957,218

[45] May 18, 1976

[54] SELF THREADABLE GROOVED ROLLERS

[75] Inventors: Robert Reid Coats; John Michael Greenway, both of Harrogate, England

[73] Assignee: Imperial Chemical Industries Limited, London, England

[22] Filed: July 29, 1975

[21] Appl. No.: 600,057

Related U.S. Application Data

[60] Continuation of Ser. No. 509,636, Sept. 26, 1974, abandoned, which is a division of Ser. No. 415,121, Nov. 12, 1973, abandoned, which is a continuation-in-part of Ser. No. 123,703, March 12, 1971, abandoned.

[30] Foreign Application Priority Data

Mar. 19, 1970 United Kingdom ..... 13357/70

[52] U.S. Cl. ..... 242/47.03; 242/47.09

[51] Int. Cl.[2] ..... B65H 51/20

[58] Field of Search ..... 242/47.01, 47.02, 47.03, 242/47.04, 47.05, 47.08, 47.09, 47.1, 47.11

[56] References Cited

UNITED STATES PATENTS

| | | | |
|---|---|---|---|
| 2,232,500 | 2/1941 | Weaver | 242/47.03 |
| 2,350,182 | 5/1944 | Neff | 242/47.03 |
| 2,518,534 | 8/1950 | Ertner | 242/47.09 X |
| 2,545,015 | 3/1951 | Barker | 242/47.03 |

FOREIGN PATENTS OR APPLICATIONS

| | | | |
|---|---|---|---|
| 18,329 | 7/1882 | Germany | 242/47.09 |
| 2,753 | 1868 | United Kingdom | 242/47.09 |
| 12,854 | 1893 | United Kingdom | 242/47.09 |
| 22,464 | 1901 | United Kingdom | 242/47.09 |

*Primary Examiner*—Stanley N. Gilreath
*Attorney, Agent, or Firm*—Cushman, Darby & Cushman

[57] ABSTRACT

A device for storing a substantial length of an advancing strand including a pair of cantilevered mounted rolls each having a plurality of grooves. The rolls are spaced apart a predetermined distance so that the strand when threaded in a plurality of figure eight loops in the grooves at the forward ends of the rolls will migrate backwards along the rolls until the loops drop into staple positions in the grooves, thereby resulting in self-threading of the strand along the rolls.

8 Claims, 5 Drawing Figures

SELF THREADABLE GROOVED ROLLERS

This application is a continuation of application Ser. No. 509,636, filed Sept. 26, 1974 (now abandoned) as a division of application Ser. No. 415,121, filed Nov. 12, 1973 (now abandoned), continuation-in-part of application Ser. No. 123,703, filed Mar. 12, 1971 (now abandoned).

This invention relates to methods of storing a substantial length of continuously advancing strand in a confined space on grooved rolls.

Various devices are known for storing a substantial length of an advancing strand, for instance to effect heat treatment or wet treatment processes in a confined space. One class of such known devices comprises a pair of plain rolls with skewed axes, or an interpenetrating and skewed pair of skeletal rolls commonly known as a thread advancing reel. The effect of providing skewed axes is that when successive arcs of a continuously advancing strand are loaded, figure of eight style, alternately on to the front portions or noses of the rolls, the arcs migrate backwards until they reach stably spaced positions controlled by the angles between the axes. This action will be called self-threadability. However, skew roll devices become less easy to adjust and use when a large number of closely spaced arcs is required and considerable precision is therefore needed to provide for a high strand storage capacity. Furthermore the positions and spacings of adjacent arcs of an advancing strand are in practice always subject to fluctuations so that closely spaced arcs tend to interfere with each other.

These problems may be overcome by using an alternative known device comprising a pair of rolls with parallel circumferential grooves in their curved surfaces, separated by ridges or lands. The axes of such rolls need not be skewed. Grooved rolls provide more positive separation and positioning of adjacent arcs of strand, one in each groove, and the control of arc spacing is by groove pitch rather than by skew angle, so that much less accuracy is needed in setting up. However, it has heretofore been necessary to thread a strand into each groove in turn to load such rolls with successive arcs of strand in successive grooves, and this becomes very inconvenient when a large number of arcs is required to provide a high storage capacity.

We have now found a method of combining the ease and simplicity of self-threadability which characterises known skewed rolls with the robustness and ease of setting up and adjustment which characterises known grooved rolls.

When a pair of circumferentially grooved rolls with parallel or nearly parallel axes carry a continuous and advancing strand, the strand may enter one extreme groove, say the rearmost groove, in one roll and then pass to the rearmost groove of the other roll and then back to the next adjacent groove of the first roll and so on alternately from one roll to the other so that each groove in each roll carries a length of strand and the strand finally leaves the storage device from the foremost groove of one of the rolls. In these circumstances the grooves may be regarded as forming a single series along the length of the strand, in which the odd numbered members of the series are grooves in one roll and the even numbered members of the series are grooves in the other roll. Any particular groove in the series may be identified by its number, and when a typical but not particular groove is referred to it may be termed the $n$th in the series. The groove $n$ has two nearest neighbours in the series, namely the groove $(n-1)$ and the groove $(n+1)$. Of course the groove $n$ is in one roll while the groove $(n-1)$ and the groove $(n+1)$ are in the other roll. The next nearest neighbours in the series, numbers $(n-2)$ and $(n+2)$, are in the same roll as the groove $n$ and indeed are adjacent to it. Certain grooves may be identified with respect to the groove $n$ by calling them the $(n \pm m)$ grooves. If $m$ is always an odd number then this set of grooves is in the roll opposite to the roll bearing the groove $n$.

According to one aspect, the present invention comprises an improvement over a known storage device for a continuously advancing strand comprising two rolls each mounted on an axis cantilevered forward from a rearward bearing, and each having a curved surface comprising parallel circumferential grooves separated by ridges or lands, and the rolls being mounted so that a strand may be passed round a series of successive arcs of contact in grooves alternately in one roll and the other so that the first and subsequent odd numbered grooves in the series are in one roll and the second and subsequent even numbered grooves in the series are in the other roll. This improvement comprises closely spacing the rolls so that their separation is that at which all the transverse common tangents from a groove in one roll which is groove $n$ in the series to the grooves in the other roll intersect ridges or lands except those transverse common tangents from the groove $n$ to grooves numbered $n \pm m$ in the series where $n$ is any number in the series and $m$ has any of the values 1, 1 and 3 and 1, 3 and 5, whereby the rolls become self-threadable.

According to another aspect the invention comprises an improved method of loading a grooved roll storage device having these characteristics, the method comprising leading a strand from a delivery means to a groove, threading the strand in a plurality of figure of eight loops around the forward ends of the rolls thereby forming a multiplicity of arcs thereon and rotating the rolls whereby the arcs migrate backwards along the rolls until they drop into stable positions in the grooves. Preferably this method is conducted by continuously withdrawing a strand under at least some tension from delivery means and collecting it in collection means, leading the strand between such delivery and collection means into an arc of contact with a groove and threading the strand between such groove and the collection means into a plurality of figure of eight loops round the forward ends of the rolls, thereby forming a multiplicity of arcs thereon which as they are formed migrate backwards along the rolls until they drop into stable positions in grooves.

In order to provide maximum storage capacity it is preferred to pass a strand round every groove in each roll and for this purpose it is preferable that $m$ has only one value, namely unity. While the axes of the rolls may be slightly skewed it is usually more convenient for them to be substantially parallel. It is also usually preferable for the rolls to be cylindrical so that the lands between the grooves are equally spaced from lands in the other roll. It will be clear that preferably the strand should be led to a rearmost groove of one roll, that the number of figure of eight loops should be equal to the number of grooves in each roll, and that all grooves should become stably loaded with arcs of strand. Conveniently the loops may be formed while the rolls rotate and advance the strand.

When this method of loading is used with two rolls so closely spaced that all the transverse common tangents from a groove in one roll to a groove in the other roll intersect ridges between grooves except for those transverse common tangents between nearest neighbouring grooves, the arcs migrate backwards on rotation of the rolls until, as preferred, they reach stable positions in which consecutive grooves in each roll are loaded with an arc of the strand. When the method is used with rolls spaced slightly further apart so that transverse common tangents between nearest neighbouring grooves and grooves separated by two in the staggered sequence both avoid intersection with ridges between grooves, the arcs migrate backwards until they reach stable positions in which every alternate groove in each roller is loaded with an arc of the strand. When the rolls are still further spaced apart it may be arranged for every third groove to be occupied by an arc of the strand, but with still further roll separation the self-threading action tends to become less useful and somewhat erratic because the differences between spacings appropriate for different modes of threading become very small.

It will be appreciated that if there were no friction between rolls and strand the rolls would neither advance the strand nor provide the self-threading action. If the coefficient of friction is particularly low, the last move in the migration of the strand, over the last ridge or land into the final stable position, may be delayed and self-threadability may be erratic. For this reason, as well as for economy in roll manufacture and space consumption we particularly prefer sufficiently close roll spacings to provide positive self-threading action into adjacent grooves, and we prefer to withdraw an advancing strand from the rolls under at least some tension during the self-threading action. We particularly prefer a slight interpenetration of lands and grooves.

When the spacing is slightly reduced between a pair of rotating rolls loaded with arcs of a strand in alternate grooves in each roller, the arcs of strand jump successively along the rolls from groove to groove until a new stable condition is reached in which adjacent grooves of each roll become loaded with arcs of strand.

By heating the rolls either internally or externally they may be used for heat treatments of yarns. Cylindrical or conical rolls providing for either constant length or a uniform rate of change of length of an advancing yarn can be mounted to provide constant spacing or interpenetration between the lands and grooves of the roller surfaces. Other combinations of changes of yarn length through the storage device may be provided for by arranging that the tips of the lands are cylindrically or conically arranged round the roller axes, allowing constant spacing along the length of the roller surfaces, and arranging that the depths of the grooves vary to permit or impose required changes of yarn length.

Grooved rolls may also be used for treatments of yarns involving diffusion or impregnation of, or chemical reaction with, fluids whether liquids or gases. For such purposes the rolls may be perforated to facilitate flow of fluids through the grooves to contact an advancing yarn.

Wherever there is a danger of yarns or filaments within a yarn breaking during passage round the grooves of the rolls and causing laps it is desirable to incorporate a lap clearing device. Scraping blade lap removers are inconvenient with closely spaced grooved rolls. One suitable lap removal device comprises a helical slot in a roll surface along which a projecting cutter blade may be urged reciprocally so that on rotation of the roll the blade moves backwards and forwards along a straight line across the grooves in the plane between the axes of the rolls whereby filaments remaining in a groove in the path of the blade are cut.

An alternative storage device comprises a pair of grooved rolls on which a blade projecting from each land projects into a groove in the other roll, whereby filaments remaining in such grooves are cut. Preferably such grooves each have an indentation in their base into which such projecting blades may penetrate and then the rolls should be geared together so that the blades may co-operate with the indentations.

Whenever the problem is more one of ensuring that all filaments move through the storage device in a coherent bundle to prevent breakage and lap formation rather than of cutting filaments which have already started to form laps, we prefer a simpler device comprising a blade placed in a plane bisecting the plane between the roll axes, one edge of the blade being placed close to the paths of advancing portions of strand on the exit side of the gap between the rolls.

It will be appreciated that self-threadable closely spaced grooved rolls according to this invention are most useful when it is required to contain a considerable length of advancing yarn in a small space in a well controlled path, as opposed for instance to a random packed path in a stuffer box or tube. A pair of cylindrical rolls, with a five-inch diameter for 1⅜ inches of their length and then slightly conical for 1⅜ inches to a nose which has a diameter 3% less than the cylindrical portion, have been provided with 16 parallel grooves per inch length of roller, each groove being V-shaped and 0.04 inch deep; giving 44 grooves in each roller. When spaced so that the lands of each cylindrical section penetrate slightly into the opposing grooves in the other roller, the rollers will receive a 150 denier polyethylene terephthalate filament yarn into their grooves and they are self-threadable even though the final lands at the noses of the conical sections do not interpenetrate. When mounted in a heated chamber and rotated at a surface speed of 5000 f.p.m., these rollers provide a heat treatment at constant length followed by a 3% relaxation, in a residence time of about 1.4 seconds. With a blade placed between the rolls as described trouble-free running was achieved but without the blade lapping occurred. As a precaution the blade was mounted on a hinge and spring loaded against locating means in the required position.

The invention will now be illustrated by way of example with reference to the accompanying drawings in each of which, for simplicity and clarity a small number of large grooves is illustrated although it will be clear that in practice a larger number of smaller grooves is usually preferable. In the accompanying drawings.

Figure 1:
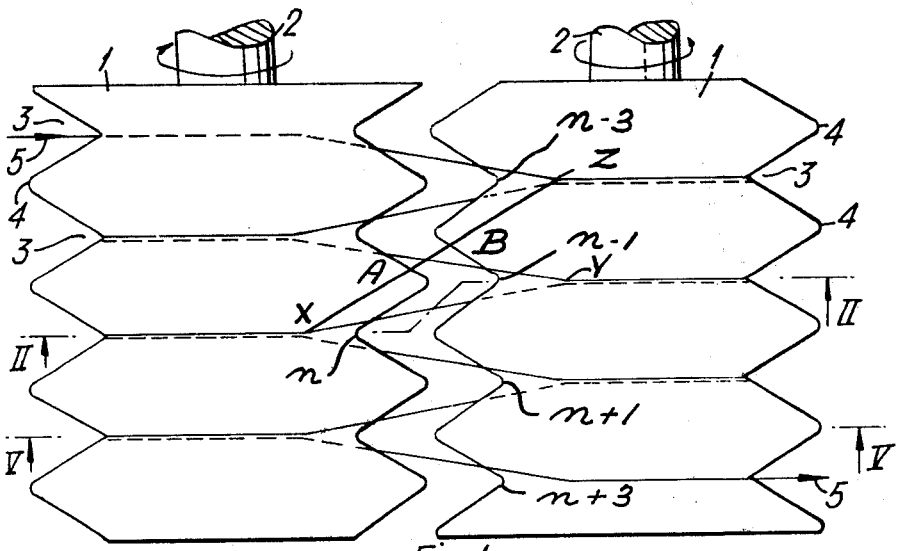
FIG. 1 is a plan view of a pair of closely spaced grooved rollers with almost interpenetrating grooves and lands.
Figure 2:
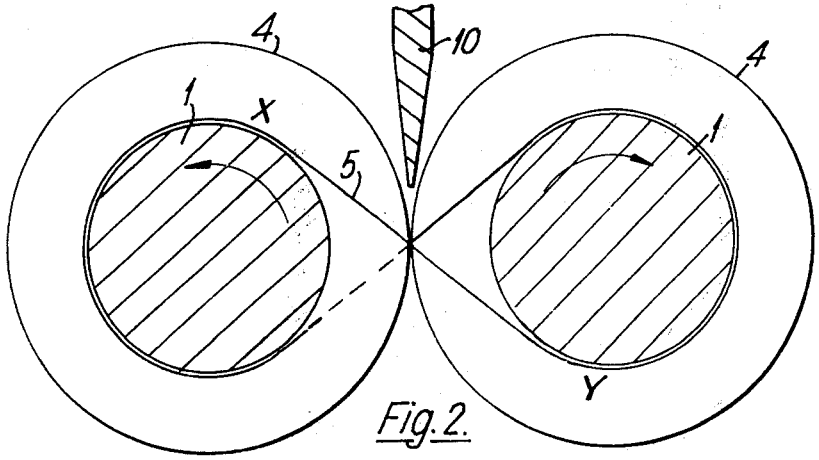
FIG. 2 is a section view of the rollers of FIG. 1 along the line II—II.

Referring to FIGS. 1 and 2, two rollers 1 rotatably mounted on axles 2 are provided with grooves 3 and lands 4, the lands just penetrating into grooves. A yarn path is indicated by the line 5. A delivery means such as a yarn package is adapted to deliver yarn to the back groove of one roller, and a forwarding means such as a wind-up device is adapted to receive yarn from the forward groove of the other roller.

In operation a yarn advancing from the delivery means either to a collection device such as a suction gun, or to the forwarding means, is looped round the forward ends of the rollers in successive figures of eight until the number of arcs of yarn loaded on to each roller equals the number of grooves in each roller. Engagement of the traveling yarn with the rolls causes the rolls to rotate and successive arcs migrate backwards and become threaded into adjacent grooves.

One of the grooves 3 in the left-hand roller is identified as $n$, and the two neighboring grooves in the right-hand roller are identified, relative to groove $n$, as grooves $(n+1)$ and $(n-1)$. Groove $(n+3)$ lies forwardly of groove $(n+1)$, and groove $(n-3)$ lies rearwardly of groove $(n-1)$. In the illustrated embodiment the threadline passing between groove $n$ and groove $(n-1)$ lies on a tangent XY which is common to grooves $n$ and $(n-1)$. However, the distance between the rollers is such that a tangent XZ between groove $n$ and groove $(n-3)$ intersects ridges at points A and B. Therefore, in this embodiment $m$, as defined previously, has a value of 1.

If the distance between the rolls of FIG. 1 is increased, then eventually the tangent XZ will fail to intersect ridges or lands, in which case $m$ will have a value of 1 and 3.

A lap suppressor blade 10 mounted on a hinge not shown may be swung away from the rolls during threading and then swung into the position shown in FIG. 2. Any filament in a multi-filament yarn which adhers more to a groove than to the yarn bundle, and is thereby drawn away from a yarn path 5, comes up against blade 10.

Figure 3:
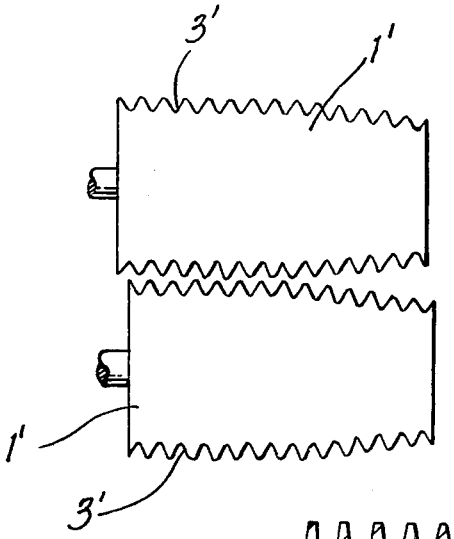
FIG. 3 is a plan view of a pair of partly conical grooved rollers with constant groove depth.

FIG. 3 illustrates a pair of rollers 1', 1' with a number of grooves 3' of equal depth in their partly cylindrical and partly conical surfaces. It will be clear that there is a strict limit on the diameter change along rollers of this form which is consistant with self-threadability.

Figure 4:
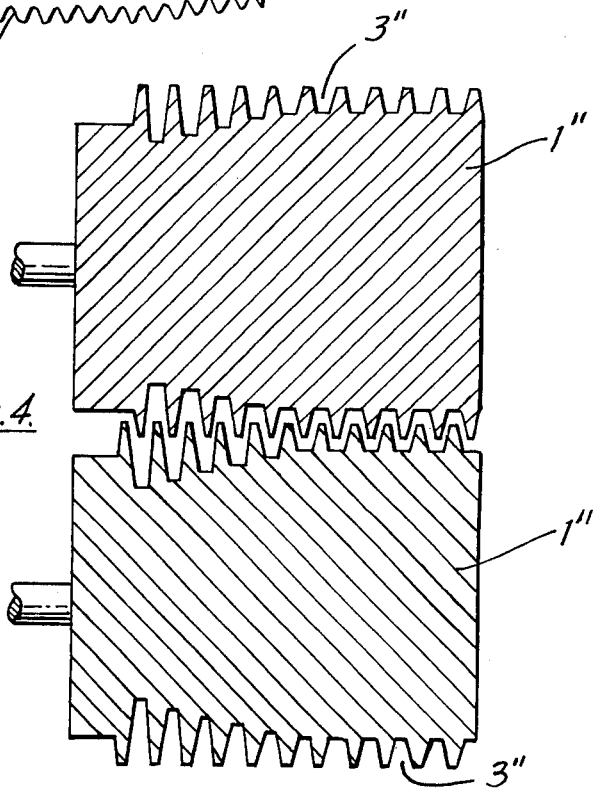
FIG. 4 is a plan view of a pair of cylindrical grooved rollers having grooves of different depths.

FIG. 4 illustrates a pair of rollers 1'' and 1'' construction in which grooves 3'' of different depth are provided in a cylindrical roller 1''. With this form of construction larger yarn length changes, whether stretching or relaxation, can be allowed for without losing self-threadability.

Figure 5:
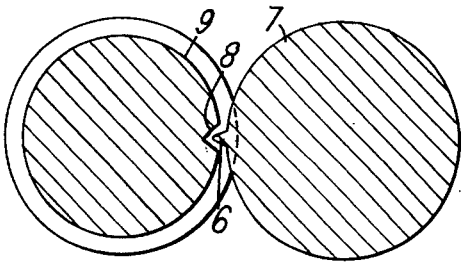
FIG. 5 is a section in the plan V—V in FIG. 1 of a pair of rollers fitted with a lap removing blade.

FIG. 5 illustrates a pair of grooves rollers with a lap cutting blade 6 extending from a land 7 of one roller into an indentation 8 in the base of a groove 9 in the adjacent roller. In operation the rollers are geared together so that the blade 6 may enter the indentation 8 and the rollers are used with a yarn path as illustrated at 5 in FIG. 2. Only a broken filament or yarn detached from the normal yarn path will lie in groove 9 at the point between the roller axes where the blade 6 enters indentation 8. The blade 6 therefore cuts such stray filaments and prevents a lap from building up in the groove.

We claim:

1. In a method of loading a strand on to a storage device comprising two rolls each mounted on an axis cantilevered forward from a rearward bearing, and each having a curved surface comprising parallel circumferential grooves separated by ridges or lands, and the rolls being mounted so that a strand may be passed round a series of successive arcs of contact in grooves alternately in one roll and the other so that the first and subsequent odd numbered grooves in the series are in one roll and the second and subsequent even numbered grooves in the series are in the other roll; the improvement comprising closely spacing the rolls so that their separation is that at which all the transverse common tangents from a groove in one roll which is number $n$ in the series to the grooves in the other roll intersect ridges or lands except those transverse common tangents from the groove $n$ to grooves number $n \pm m$ in the series where $n$ is any number in the series and $m$ has any of the values 1, 1 and 3 and 1, 3 and 5, leading the strand from a delivery means to a groove, threading the strand in a plurality of figure of eight loops around the forward ends of the rolls thereby forming a multiplicity of arcs thereon and rotating the rolls whereby the arcs migrate backwards along the rolls until they drop into stable positions in the grooves.

2. A method according to claim 1 wherein $m$ is unity.

3. A method according to claim 1 in which the strand is continually advancing between delivery means and collection means and is loaded on to the storage device between such delivery and collection means.

4. A method according to claim 3 wherein $m$ is unity.

5. A method for loading a strand onto a pair of circumferentially grooved rolls comprising the steps of locating the two rolls so that grooves formed thereon from a series in staggered alternating sequence about the central line between the points of closest approach of said grooved rolls, closely spacing the rolls so that their separation is that at which all the transverse common tangents from a groove number $n$ in the series to the grooves in the other roll intersect ridges or lands except those transverse common tangents from groove number $n$ to grooves numbered $n \pm$ in the series where $n$ is any number in the series and $m$ has any of the values 1, 1 and 3 and 1, 3 and 5, leading a strand from a delivery means to a groove, threading the strand in a plurality of figure eight loops around the noses of said grooved rolls thereby forming a multiplicity of arcs thereon, rotating each of said grooved rolls so that said arcs migrate backwards along each of said rolls from their noses until said arcs assume stable positions in said grooves.

6. A method according to claim 5 wherein $m$ is unity.

7. A method according to claim 5 in which the strand is continuously advancing between delivery means and collection means and is loaded onto the storage device between such delivery and collection means.

8. A method according to claim 7 wherein $m$ is unity.

* * * * *